United States Patent [19]

Miller

[11] 4,382,507

[45] May 10, 1983

[54] ABSORBENT PAD

[75] Inventor: Alan H. Miller, Hickory, N.C.

[73] Assignee: Cellu Products Company, Patterson, N.C.

[21] Appl. No.: 249,941

[22] Filed: Apr. 1, 1981

Related U.S. Application Data

[60] Division of Ser. No. 96,797, Nov. 23, 1979, Pat. No. 4,275,811, which is a continuation-in-part of Ser. No. 69,074, Aug. 23, 1979, abandoned, which is a continuation of Ser. No. 885,622, Mar. 13, 1978, abandoned.

[51] Int. Cl.[3] ..... B65D 81/26; B65D 81/22

[52] U.S. Cl. ..... 206/204; 206/205; 239/56; 426/124

[58] Field of Search ..... 206/204, 205; 229/2.5 R; 239/56; 426/124, 129; 128/296; 428/116

[56] References Cited

U.S. PATENT DOCUMENTS

| | | | |
|---|---|---|---|
| 3,026,209 | 3/1962 | Niblack et al. | 206/204 X |
| 3,886,941 | 6/1975 | Duane et al. | 128/287 |
| 3,929,135 | 12/1975 | Thompson | 128/287 |
| 4,055,180 | 10/1977 | Karami | 128/287 |

*Primary Examiner*—William T. Dixson, Jr.
*Assistant Examiner*—Brenda J. Ehrhardt
*Attorney, Agent, or Firm*—Bell, Seltzer, Park & Gibson

[57] ABSTRACT

An absorbent pad is provided which is useful in a receptacle for containing and displaying food products which tend to exude juices or liquids. The absorbent pad comprises a mat of liquid absorbent material, which comprises a layer of paper wadding and a layer of wood fluff, with the layers being mechanically interconnected. A plastic liquid impermeable sheet overlies one side of the mat, and a plastic perforated sheet overlies the other side. When the food product is positioned upon the upper sheet of the absorbent pad, any exuded liquids will flow around the pad and enter the mat by capillary action through the perforated openings of the bottom sheet, and the liquids will be held out of contact with the food product to thereby minimize contamination of the product and maintain its appearance and improve its shelf-life. The pad also has independent utility as a moisturizing device for use in closed food containers or packages.

6 Claims, 9 Drawing Figures

ABSORBENT PAD

This is a division of application Ser. No. 096,797, filed Nov. 23, 1979, now U.S. Pat. No. 4,275,811 which is a continuation-in-part of application Ser. No. 069,074, filed Aug. 23, 1979, now abandoned, and which in turn is a continuation of application Ser. No. 885,622, filed Mar. 13, 1978 and now abandoned.

The present invention relates to an improved absorbent pad which is useful in a receptacle of the type used to contain and display various food products, and which acts to substantially improve the appearance and shelf-life of the food product.

It is conventional practice to display meat, poultry, and other food products in individual packages which comprise a supporting tray with an absorbent pad of tissue-like paper wadding in the bottom of the tray to absorb any juices or liquids exuded from the food product. A transparent outer plastic wrapping is also usually employed to cover and surround the package. A major problem associated with such packages is the fact that the exuded liquids support the rapid growth of bacteria, which migrate back to the food product and result in spoilage and discoloration thereof. As will be apparent, such spoilage and discoloration quickly renders the food product unsuitable for sale.

In an effort to alleviate the above problem, and to extend the shelf-life of such food products, it has been proposed to employ an absorbent pad in the package which includes an imperforate plastic film positioned above a layer of absorptive wadding, and such that the plastic film acts to retard the reverse migration of the liquids back to the food products. Also, it has been proposed to position a non-absorptive barrier above the absorbent material for this purpose, note the U.S. patent to Niblack et al. U.S. Pat. No. 3,026,209. While the above package constructions provide a spacial relationship between the exuded liquids in the pad and the food product, they nevertheless permit the substantial migration of bacteria back to the food product and thus are not totally satisfactory.

It is accordingly an object of the present invention to provide an absorbent pad which is useful in a receptacle for displaying food products which substantially alleviates the problem of food spoilage and discoloration resulting from bacterial growth within the exuded liquids, and thus materially contributes to the shelf-life of the food product.

It is a more particular object of the present invention to provide an absorbent pad for a display receptacle of the described type and which has provision for isolating the exuded liquids from the food product to thereby substantially preclude the reverse migration of the bacteria back to the food product.

Additional objects of the present invention are to provide an absorbent pad for a display receptacle which is aesthetically pleasing, which is able to hold and retain a substantial quantity of liquid, and which permits the use of chemical additives in the absorptive material while preventing the additives from contacting the food product. It is also an object of the present invention to provide an absorbent pad useful in a display package as described above, and which has separate utility as a means for providing moisture to various food products, such as lettuce or mushrooms, while stored in a closed container.

These and other objects and advantages of the present invention are achieved in the embodiments illustrated hereby by the provision of an absorbent pad which comprises a mat of liquid absorbent material, an imperforate, liquid impermeable upper sheet overlying and covering the mat of absorbent material, and a bottom sheet of liquid impermeable material underlying the mat. The peripheral edges of the upper and bottom sheets are sealed together to enclose the mat of absorbent material therebetween, and the bottom sheet includes a plurality of openings which permit passage of a liquid into the absorbent material and such that the liquid is held by the mat out of contact with the food product. The liquid absorbent material of the pad is preferably composed of superposed layers of paper wadding and wood fluff, and with the layer of paper wadding being disposed immediately adjacent the apertured bottom sheet and so as to prevent dust from the wood fluff from passing outwardly through the openings.

In one embodiment, the pad is disposed upon the bottom wall of a supporting tray, with the bottom sheet of the pad disposed adjacent the tray bottom wall and so that the food product may be disposed upon the upper imperforate sheet of the pad. The liquids exuded from the food product thus pass around the edges of the pad and onto the bottom wall of the tray, and are drawn upwardly into the mat through the openings by capillary action. Once in the mat, the liquids are confined against reverse flow by the capillary action, and the imperforate upper sheet acts to prevent migration of bacteria, which may develop in the liquids, back to the food product. In another embodiment, the pad is disposed within a flexible transparent plastic bag, with the apertured bottom sheet of the pad disposed against the wall of the bag, and so that a food product may be retained in the bag in contact with the upper sheet of the pad and the exuded liquids collected and confined in the pad in the above described manner.

Some of the objects having been stated, other objects will appear as the description proceeds, when taken in connection with the accompanying drawings, in which.

Figures 1, 2, 3, 4, 5:
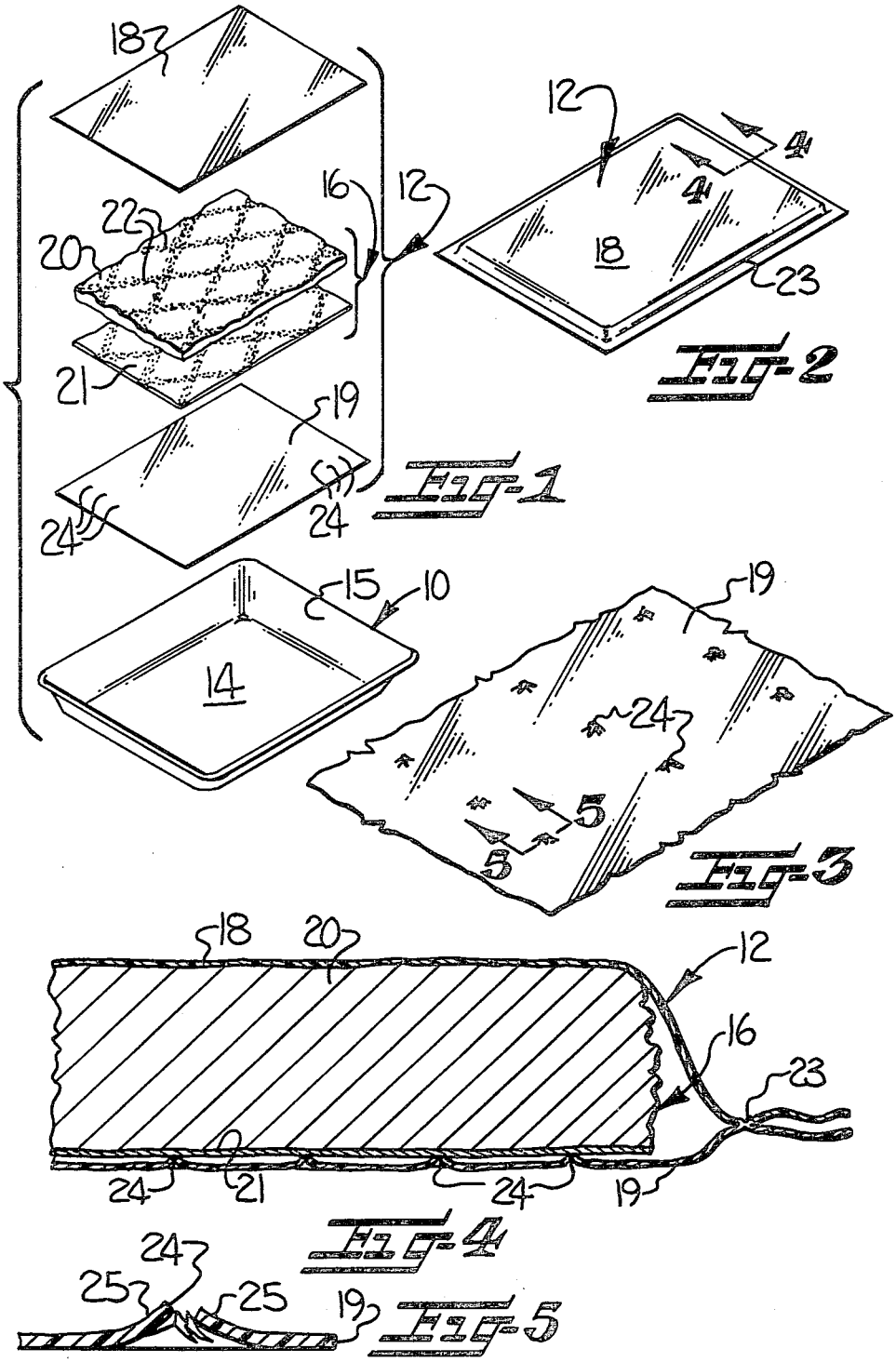
FIG. 1 is an exploded perspective view of a receptacle for food products which embodies the features of the present invention.
FIG. 2 is a perspective view of the absorbent pad of the present invention.
FIG. 3 is an enlarged, fragmentary perspective view of the bottom sheet of the pad.
FIG. 4 is an enlarged, fragmentary sectional elevation view of the pad and taken substantially along the line 4—4 of FIG. 2.
FIG. 5 is an enlarged, fragmentary sectional elevation view showing the openings in the bottom sheet and taken substantially along the line 5—5 of FIG. 3.
Figure 6:
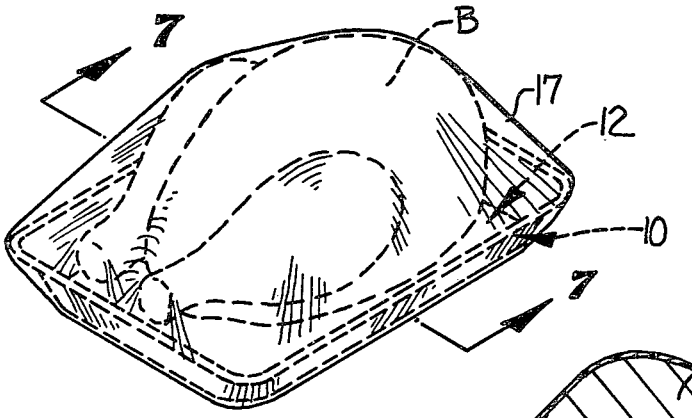
FIG. 6 is a perspective view of the display receptacle as shown in FIG. 1, together with the packaged food product and surrounding plastic wrap.
Figure 7:
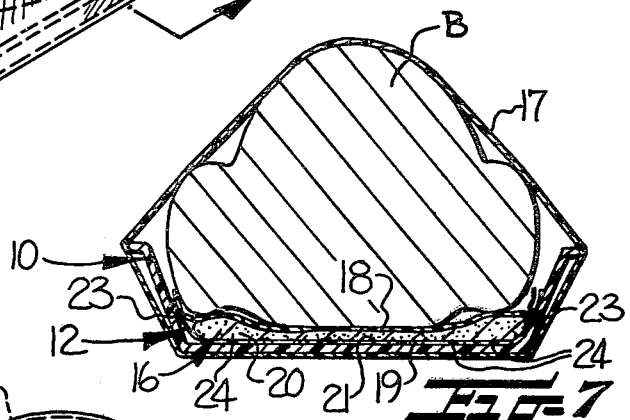
FIG. 7 is a sectional view taken substantially along the line 7—7 of FIG. 6.

Referring more specifically to the drawings, FIG. 1 discloses a display receptacle which embodies the present invention, and which comprises a support tray 10, and an absorbent pad 12. The support tray 10 may conveniently be fabricated from a relatively rigid molded foam plastic material, and includes a generally rectangular bottom wall 14 and an upstanding peripheral side wall 15. The absorbent pad 12 is also rectangular, and is sized to overlie substantially the full area of the bottom wall 14 of the tray. In use, the pad 12 is positioned upon the bottom wall 14, and the food product B (note FIG. 6) is positioned to rest upon the pad. Further, an outer wrapping of suitable thermoplastic film material 17 may be positioned over the food product and heat sealed beneath the tray 10 in the conventional manner, to form the completed food package.

The pad 12 comprises a mat 16 of liquid absorbent material, an upper sheet 18 of substantially liquid impermeable hydrophobic material overlying and covering the mat of absorbent material, and a bottom sheet 19 of hydrophobic material underlying the mat of absorbent material so as to be disposed between the mat and the tray bottom wall 14.

The thickness of the mat 16 may be varied to control the absorbency thereof, and typically is between about $\frac{1}{8}$ to $\frac{1}{4}$ inches so as to permit absorption and retention of a substantial quantity of liquid. The mat may be composed of a number of absorbent materials, such as stacked layers of tissue-like wadding, a mat of conventional defiberized wood pulp (known in the art as wood fluff), a mat of synthetic pulp such as rayon, a mat of cotton, or combinations of the above.

In the preferred embodiment as illustrated herein, the mat 16 is composed of hydrophilic cellulose base fibers, and more particularly, the mat is composed of a relatively thick layer of wood fluff 20, and a relatively thin layer of tissue-like paper wadding 21. Wood fluff is well known in the art and consists of defiberized cellulose fibers which have been formed into a compressed batt in the manner of a non-woven fabric. The fluff layer has little or no consistency or integrity, and it is thus difficult to maintain in web form during manufacturing operations. The paper wadding 21, which is also known in the art, is produced on a Fourdrinier paper making machine, and may, if desired, be creped for added body. The wadding typically has a texture similar to household facial tissue, and has substantially more integrity than does the wood fluff.

The layers of wadding and wood fluff are superposed and mechanically interconnected by the diamond-shaped embossing 22 to maintain the relative positioning thereof and the integrity of the wood fluff, and to facilitate handling of the fluff during the manufacturing operations. The embossing 22 typically comprises myriad distinct identations along the lines of the diamond-shaped pattern and which serve to compact and thereby interconnect the superposed layers along those lines. Such embossing may be imparted to the mat by passing the superposed layers through conventional embossing rolls (not shown). As best seen in FIG. 4, the wadding layer 21 is preferably disposed immediately adjacent the perforated bottom sheet 19 as hereinafter further described, and in this orientation, it has been found that the wadding layer also acts to prevent any loose fluff dust from passing through the openings and possibly contaminating the food product.

Various additives may be added to the mat to increase its liquid absorbency. A particular example of a suitable additive of this type is a synthesized starch, such as the starch-acrylonitrile graft co-polymer as described in U.S. Pat. No. 3,661,815. This product is marketed commercially as a free flowing powder, which may be either sifted onto the fluff layer or sifted into the fluff chamber when the layer is being formed. In addition, a bactericidal agent, such as potassium sorbate, may be added to the mat to retard bacterial growth.

The upper and lower sheets 18 and 19 are typically of like composition and are composed of a material which is non-reactive to food products. For example, the sheets may comprise a flexible thermoplastic film, such as polyethylene having a thickness between about 0.00035 to 0.005 inches. The peripheral edges of the upper and bottom sheets are preferably sealably secured together as shown at 23 by any suitable means, such as a hot melt adhesive seal, or by heat sealing, to thereby sealably enclose the mat of absorbent material therebetween. In addition, the bottom sheet 19 includes a plurality of minute openings 24 which permit the passage of a liquid from the tray bottom wall into the absorbent material. The openings 24 are distributed substantially uniformly over the full area of the sheet and typically have a density of between about 15 and 100 per square inch, and preferably between about 80 to 90 per square inch. In this regard, the openings 24 may be formed by a perforating operation, such as by contacting the film with a roll covered with pins having a diameter of about 0.01 inches, and of the type used on a textile carding cloth. Such perforating operation results in the openings having a diameter of about 0.01 inches, and peripheral portions 25 (note FIG. 5) which extend outwardly from the sheet. Also, the sheet is oriented so that the peripheral portions 25 extend toward the mat 16 and thereby act to further retard the passage of liquid outwardly from the mat and through the sheet.

In use, the juices or liquids from the food product resting on the pad 12 will tend to flow downwardly onto the bottom wall 14 of the tray and beneath the pad. The capillary action of the absorbent material in the mat 16 tends to lift these liquids into the pad where they are held out of contact with the food product. The upper sheet 18 prevents these absorbed liquids and any additives in the mat from directly contacting the food product, and the combination of the capillary action and the small size and construction of the openings 24 acts to retard the reverse flow of the liquids through the openings. Thus substantially all migration of the exuded liquids back to the food product is precluded, thereby significantly alleviating the problems of spoilage and discoloration. Further, the upper surface of the sheet 18 remains relatively clean and smooth in use thereby resulting in an aesthetically pleasing appearance.

Figure 8:
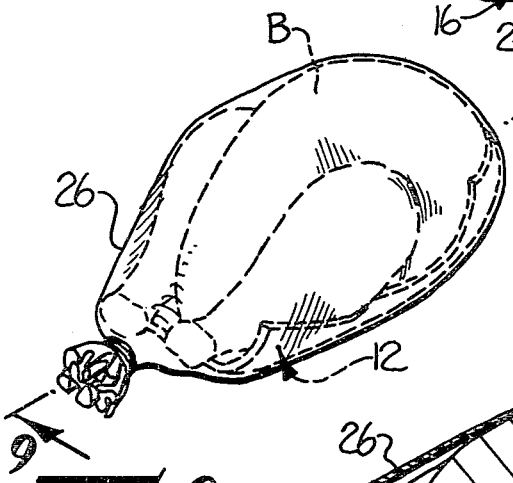
FIG. 8 is a perspective view of another embodiment of the receptacle, which comprises a pad disposed within a flexible transparent plastic bag, and further illustrating the packaged food product.
Figure 9:
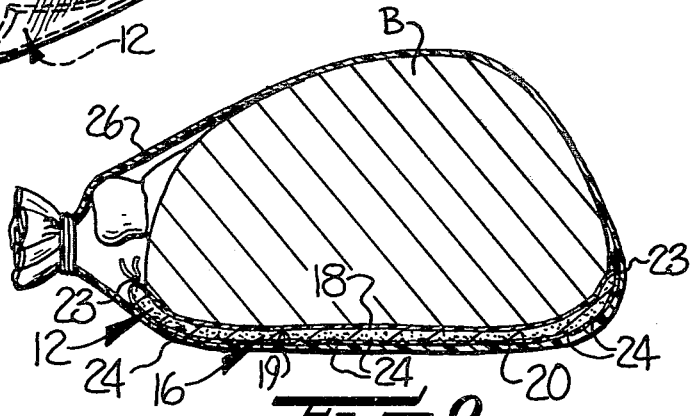
FIG. 9 is a sectional view taken substantially along the line 9—9 of FIG. 8.

FIGS. 8 and 9 illustrate a further embodiment of the present invention wherein the pad 12 as described above is disposed within a transparent flexible plastic bag 26 having a closeable end opening. The pad is disposed with the apertured bottom sheet 19 contacting the wall of the bag, and the food product B is preferably oriented so as to overlie the pad and rest upon the upper sheet 18. Thus the exuded liquids will flow downwardly and beneath the pad in the manner described above, where they are drawn into the mat and thus confined out of contact with the food product.

It has also been found that the pad 12 has separate utility as a hydrating or moisturizing device, whereby moisture may be provided to various food products, such as lettuce or mushrooms, while stored in a closed container or package. In particular, the pad may be thoroughly saturated by dipping in water, and then placed in the food container or package. The water in the pad will slowly vaporize, and pass outwardly through the openings 24 to thereby maintain a relatively high humidity level within the container or package.

In the drawings and specification, there has been set forth a preferred embodiment of the invention, and although specific terms are employed, they are used in a generic and descriptive sense only and not for purposes of limitation.

What is claimed is:

1. An absorbent pad useful in a food package to separate and maintain the exuded liquids from the food product to thereby minimize contamination of the food product, or as a device for moisturizing a closed food container or package, and comprising a mat of liquid absorbent material comprising a layer of paper wadding and a layer of wood fluff, said layers of paper wadding and wood fluff being mechanically interconnected to maintain the relative positioning thereof and the integrity of the wood fluff, a first sheet of liquid impermeable plastic material overlying and covering one side of said mat of liquid absorbent material, and a second sheet of plastic material overlying and covering the other side of said mat of liquid absorbent material, the peripheral edges of said first and second sheets being sealed together to enclose said mat therebetween, and with said second sheet only having a plurality of openings spaced over substantially the full area thereof and which permit passage of a liquid into said mat so as to be retained thereby, and wherein a layer of paper wadding is positioned immediately adjacent said second sheet, whereby said paper wadding acts to prevent dust from said wood fluff from passing outwardly through said openings.

2. The absorbent pad as defined in claim 1 wherein said mat of liquid absorbent material further comprises a liquid absorbing synthesized starch.

3. The absorbent pad as defined in claim 1 or 2 wherein said mat of liquid absorbent material further comprises a bacteriostatic agent.

4. The absorbent pad as defined in claim 1 wherein said openings have a diameter of about 0.01 inches and a density of between about 15 and 100 per square inch.

5. The absorbent pad as defined in either claim 1 or 4 wherein said openings include peripheral portions which are inclined outwardly from said second sheet and toward said mat, to thereby further retard the reverse flow of liquids outwardly from the mat and through said openings.

6. The absorbent pad as defined in claim 1 wherein said first and second sheets each have a thickness of between about 0.00035 and 0.005 inches.

* * * * *